US008371213B2

(12) United States Patent
Correale, Jr. et al.

(10) Patent No.: US 8,371,213 B2
(45) Date of Patent: Feb. 12, 2013

(54) DIAGNOSTIC SYSTEM FOR COMPACTOR/BALER APPARATUS

(75) Inventors: Edward Howard Correale, Jr., Levittown, PA (US); Robert John Ruby, Elkins Park, PA (US)

(73) Assignee: PTR Baler and Compactor Company, Philadelphia, PA (US)

( * ) Notice: Subject to any disclaimer, the term of this patent is extended or adjusted under 35 U.S.C. 154(b) by 338 days.

(21) Appl. No.: 12/883,975

(22) Filed: Sep. 16, 2010

(65) Prior Publication Data

US 2011/0061546 A1 Mar. 17, 2011

Related U.S. Application Data

(60) Provisional application No. 61/242,912, filed on Sep. 16, 2009.

(51) Int. Cl.
*B30B 15/26* (2006.01)
*B65B 57/10* (2006.01)

(52) U.S. Cl. ..... 100/43; 100/4; 100/50; 100/51; 100/99

(58) Field of Classification Search ..... 100/4, 43, 100/48, 49, 50, 51, 99
See application file for complete search history.

(56) References Cited

U.S. PATENT DOCUMENTS 3,784,657 A * 1/1974 Hutchinson et al. ..... 264/40.4
4,274,282 A * 6/1981 Budraitis et al. ..... 73/862.625
4,603,625 A * 8/1986 Brown ..... 100/347
4,953,109 A 8/1990 Burgis
5,299,493 A 4/1994 Durbin et al.
5,303,642 A 4/1994 Durbin et al.
5,514,338 A 5/1996 Simon et al.
5,626,086 A * 5/1997 Malone ..... 110/190
6,021,712 A * 2/2000 Harrop ..... 100/43
6,055,902 A * 5/2000 Harrop et al. ..... 100/52
6,123,017 A * 9/2000 Little et al. ..... 100/35
6,360,186 B1 3/2002 Durbin
6,408,261 B1 6/2002 Durbin
6,453,270 B1 9/2002 Durbin
6,561,085 B1 5/2003 Durbin et al.
6,687,656 B2 2/2004 Durbin et al.
6,738,732 B2 5/2004 Durbin et al.
6,742,448 B1 6/2004 Davis et al.
7,145,450 B2 12/2006 Brown
7,397,907 B2 7/2008 Petite
7,481,160 B1 1/2009 Simon et al.

* cited by examiner

*Primary Examiner* — Jimmy T Nguyen
(74) *Attorney, Agent, or Firm* — Panitch Schwarze Belisario & Nadel LLP

(57) ABSTRACT

A diagnostic system for a compactor/baler includes a controller and a plurality of switches coupled to inputs of the controller. A first switch is in a first position when a ram of the compactor/baler is below a predetermined location, and a second position when the ram reaches the location. A second switch is in a first position when pressure driving the ram is below a predetermined pressure limit, and a second position when the ram exceeds the pressure limit. A communication port and display are operatively coupled to outputs of the controller. The controller is configured to, upon actuation of the first switch to the first position, activate a ram timer to count to a predetermined timer setting, and, if the second switch is actuated to the second position before the ram timer reaches the timer setting, output an alert of a full bale condition the communication port and/or display.

17 Claims, 17 Drawing Sheets

DIAGNOSTIC SYSTEM FOR COMPACTOR/BALER APPARATUS

CROSS-REFERENCE TO RELATED APPLICATIONS

This application claims the benefit of U.S. Provisional Patent Application No. 61/242,912, filed on Sep. 16, 2009 and entitled "Diagnostic System for Compactor/Baler Apparatus," the entire contents of which are incorporated by reference herein.

BACKGROUND OF THE INVENTION

Embodiments of the present invention relate generally to a compactor/baler apparatus and, more particularly to a commercial/industrial type waste/trash compactor/baler apparatus which includes a diagnostic system for monitoring certain operating parameters and other characteristics of the compactor/baler apparatus and providing alerts to a user and/or to a remote location such as a service facility.

Compactors of the type used by commercial/industrial users for compacting trash, particularly recyclable trash, such as paperboard or cardboard boxes, are generally known. Such compactors generally include a container or housing with a closable opening or door for inserting the trash to be compacted and a powered compacting device, such as a hydraulically powered ram for compressing or compacting the trash within the housing. Such compactors typically also include a device for baling the compacted trash and a closable opening for convenient removal from the housing a bale of the compacted trash, which can then be transported to a waste or recycling facility.

While existing compactor/baler apparatuses are very effective, there are several components within the apparatuses which are occasionally subject to mechanical failure and must be repaired or replaced. In addition, there is a need to perform periodic maintenance on such compactor/baler apparatuses for avoiding potential unpredictable down time. There is also a need for monitoring certain parameters of such compactor/baler apparatuses to develop methods for predicting potential failures so that components may be replaced or other action may be taken in advance of any such failures.

It is desired to provide a diagnostic system for a compactor/baler apparatus for tracking the operation of the apparatus and particularly certain components and operational features of the apparatus and providing information and alerts to a user. In addition to assisting the user with normal operation of the apparatus, it is desired that the diagnostic system provide the user and/or a service facility or other location with information and alerts as to failures and potential failures of components of the apparatus which require maintenance, either immediately or in the future, to avoid or at least diminish a potentially disruptive failure of the compactor/baler apparatus.

BRIEF SUMMARY OF THE INVENTION

Briefly stated, an embodiment of the present invention comprises a diagnostic system for a compactor/baler apparatus including a controller having a plurality of inputs and a plurality of outputs and a plurality of switches each coupled to a respective one of the plurality of inputs of the controller. A first of the plurality of switches is in a first position when a ram of the compactor/baler apparatus is below a predetermined location and is in a second position when the ram reaches the predetermined location. A second of the plurality of switches is in a first position when a pressure driving the ram is below a predetermined pressure limit and is in a second position when the ram exceeds the predetermined pressure limit. A communication port is operatively coupled to a first output of the plurality of outputs of the controller. A display is operatively coupled to a second output of the plurality of outputs of the controller. The controller is configured to, upon actuation of the first switch to the first position, activate a ram timer to count to a predetermined timer setting, and, if the second switch is actuated to the second position before the ram timer reaches the predetermined timer setting, output an alert indicating a full bale condition to at least one of the communication port and the display.

Another embodiment of the present invention comprises a diagnostic system for a compactor/baler apparatus including a controller having a plurality of inputs and a plurality of outputs and a plurality of switches each coupled to a respective one of the plurality of inputs of the controller. A first of the plurality of switches is in a first position while a start down button is actuated to initiate downward motion of a ram of the compactor/baler apparatus in a downward direction, and otherwise is in a second position. A second of the plurality of switches is in a first position when a ram gate of the compactor/baler apparatus is closed and is in a second position when the ram gate is open. A third of the plurality of switches is in a first position when a feed gate of the compactor/baler apparatus is open and is in a second position when the feed gate is closed. A communication port is operatively coupled to a first output of the plurality of outputs of the controller. A display is operatively coupled to a second output of the plurality of outputs of the controller. A down solenoid is selectively connectable to a power supply of the compactor/baler apparatus by a third output of the plurality of outputs of the controller. The down solenoid is configured to move the ram in a downward direction when connected to the power supply. An up solenoid is selectively connectable to the power supply by a fourth output of the plurality of outputs of the controller. The up solenoid is configured to move the ram in an upward direction when connected to the power supply. The controller is configured to increment a cycle counter following completion of a sequence wherein the down solenoid is connected to the power supply for a first period of time and subsequently the up solenoid is connected to the power supply for a second period of time, and output an alert to at least one of the communication port and the display based upon detection, by the controller, of a predetermined configuration of the plurality of switches.

BRIEF DESCRIPTION OF THE SEVERAL VIEWS OF THE DRAWINGS

The following detailed description of the invention will be better understood when read in conjunction with the appended drawings. For the purpose of illustrating the invention, there is shown in the drawings an embodiment which is presently preferred. It should be understood, however, that the invention is not limited to the precise arrangements and instrumentalities shown.

In the drawings.

DETAILED DESCRIPTION OF THE INVENTION

Figure 1:
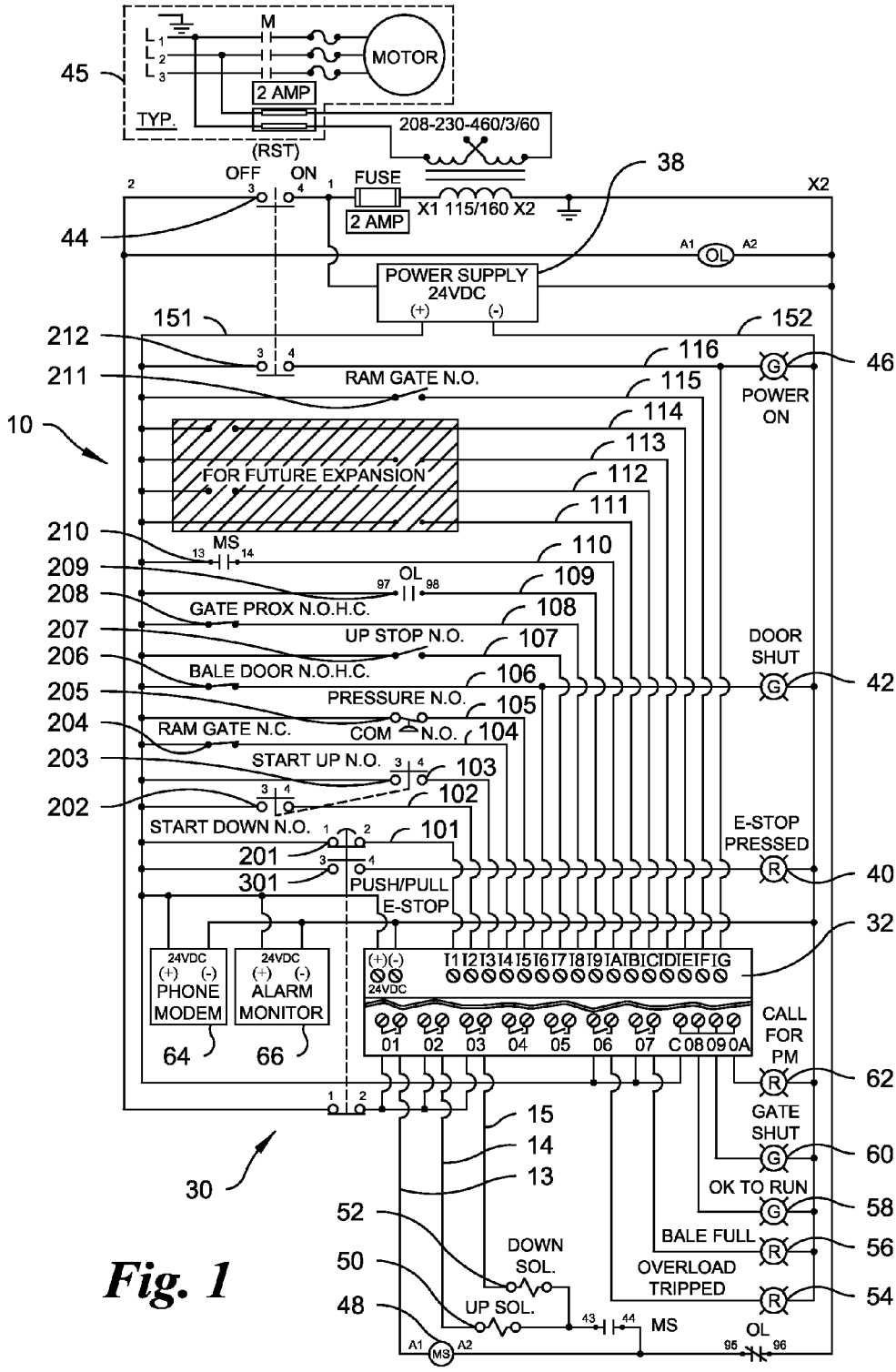
FIG. 1 is a schematic diagram of the components of a diagnostic system for a compactor/baler apparatus in accordance with a preferred embodiment of the present invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the diagnostic system and designated parts thereof. Unless specifically set forth herein, the terms "a", "an" and "the" are not limited to one element but instead should be read as meaning "at least one". The terminology includes the words noted above, derivatives thereof and words of similar import.

Referring to the drawings, wherein the same reference numerals are used to designate the same components throughout the several figures, there is shown in FIG. 1, a schematic diagram of the principal components of a diagnostic system 10 in accordance with a preferred embodiment of the present invention. The diagnostic system 10 is adapted to be used with and to become a part of a trash compactor/baler apparatus 30 of a conventional type. Complete details of the structural and operational features of the compactor/baler apparatus 30 are available from any of various manufacturers, such as PTR Baler and Compactor Company of Philadelphia Pa., the assignee of the present invention. Such detailed structural and operational information is not needed for a complete understanding of the present invention and will only be presented herein as needed. Suffice it to say that the compactor/baler 30 includes a container or housing (not shown) having a feed gate or chamber door for insertion of trash or other materials to be compacted into a bale chamber, a hydraulically operated ram for moving downwardly within the container for compacting the inserted trash or other materials and a bale door for ejecting or removing from the bottom of the container trash or other materials which have been compacted by the ram and then baled. The compactor/baler 30 includes a keyed on/off switch for locking out operation of the compactor/baler 30, an emergency stop button for immediately stopping the operation of the compactor/baler 30, an up/down start switch for starting the upward or downward movement of the ram and a plurality of indicator lights which when illuminated display the status of various functions of the compactor/baler 30.

The heart of the diagnostic system 10 is a controller, in the present embodiment a programmable logic controller (PLC) 32. In the present embodiment the PLC 32 is a Millenium 3 logic controller available from Crouzet of Valence Cedex, France. It will be appreciated by those skilled in the art that other types of PLCs available from other manufacturers could alternatively be used or that other types of controller devices, processors, microprocessors or the like could alternatively be employed. As best shown in FIG. 3 and as described in greater detail below, the PLC 32 includes a multiline liquid crystal display (LCD) 34 for providing output information to a user or on site service technician and a plurality PLC input pushbuttons 36 which may be used for selecting the information to be displayed on the LCD 34 by scrolling through the screens of the LCD 34. The pushbuttons 36 can also be used to reset certain counters (described below), extinguish certain indicator lights (discussed below) and to clear certain errors or faults (discussed below). The PLC 32 is programmed by utilizing instructions provided by the manufacturer in accordance with the flow diagrams shown in FIGS. 2A-N and by selectively using the pushbuttons 36. It will be apparent to those skilled in the art that any other suitable input/output device, including some other type of display, such as a touch screen, could alternatively be employed.

The PLC 32 monitors all interlocks, switches and other sensing devices within the compactor baler 30 and also controls the motor, hydraulic valve, indicators and all other operations of the compactor/baler 30. Errors and faults (described below) are monitored by the PLC 32 as necessary to protect the compactor/baler 30 from potential damage and to protect the user from injury during operation. Referring again to FIG. 1, the PLC 32 receives a plurality of electrical input signals which are indicative of the status of various components, switches and other sensing devices of the compactor/baler 10. The PLC 32 uses the input signals and the software program to generate output signals which provide diagnostics of the operation and performance of the compactor/baler 30 as well as needed maintenance information. In the present embodiment the diagnostic system 10 includes a power supply 38, which provides a positive 24 volt DC output voltage. The positive 24 volt DC voltage is provided to a first terminal of each of a plurality of switches, in the present embodiment twelve switches, the second terminal of each of which is connected to a separate input pin or terminal of the PLC 32. Thus, for example, when one of the switches is closed, a positive 24 volts DC signal is provided to the corresponding input terminal of the PLC 32 and when one of the switches is opened, the positive 24 volt DC voltage signal is removed from the corresponding input terminal of the PLC 32. The switches which are used to provide input signals to the PLC 32 are individually described as follows:

A first, normally open switch 201 is associated with an emergency stop button (not shown) on the compactor/baler 30. When the emergency stop button is actuated by a user to stop the operation of the compactor/baler 30 the first switch 201 is closed so that a 24 volt DC voltage is provided along line 101 to input terminal I1 of the PLC 32. An additional normally open switch 301 associated with the emergency stop button also provides a 24 volt DC voltage to illuminate an emergency stop indicator light 40 whenever the emergency stop button is actuated by the user to close the switch 301.

A second, normally open switch 202 is associated with the start down button of the compactor/baler 30. The start down button is actuated by a user when it is desired to begin downward movement of the compactor ram for compressing trash within the compactor housing. Whenever the start down button is actuated by a user the second switch 202 is closed so that a 24 volt DC voltage is provided along line 102 to input terminal I2 of the PLC 32.

A third, normally open switch 203 is associated with the start up button (not shown) of the compactor/baler 30. The start up button is actuated by a user for movement of the compactor ram in the upward direction. Whenever the start up button is actuated by a user, the third switch 203 is closed so that a 24 volt DC voltage is provided along line 103 to input terminal I3 of the PLC 32.

A fourth, normally closed switch 204 is associated with the ram gate (not shown) of the compactor/baler 30. The ram gate is normally closed during all operations of the compactor/baler 30 and as long as the ram gate remains closed a 24 volt DC voltage is provided along line 104 to terminal I4 of the PLC 32. Whenever the ram gate is open, the fourth switch 204 is open so that the 24 volt DC voltage is removed from input terminal I4 of the PLC 32.

A fifth, normally open switch 205 is associated with the hydraulic pressure used for driving the movement of the ram of the compactor/baler 30. When the hydraulic pressure exceeds a predetermined pressure limit, the fifth switch 205 is closed so that a 24 volt DC voltage is provided along line 105 to input terminal I5 of the PLC 32.

A sixth, normally open switch 206 is associated with the bale door (not shown) of the compactor/baler 30, which is used for the removal of completed bales. The bale door is normally closed during all operations of the compactor/baler 30. Whenever the bale door is open, the sixth switch 206 is closed so that a 24 volt DC voltage is provided along line 106 to the input terminal I6 of the PLC 32. In addition, when the sixth switch 206 is closed, a 24 volt DC voltage is provided to illuminate a bale door shut indicator light 42 to confirm to the user that the bale door is open and should be closed.

A seventh, normally open switch 207 is associated with the up stop limit switch (not shown) of the compactor/baler 30. The up stop limit switch is actuated when the upward movement of the compactor ram reaches a predetermined location. Whenever the up stop limit switch is actuated by an upward movement of the ram beyond the predetermined limit, the seventh switch 207 is closed so that a 24 volt DC voltage is provided along line 107 to input terminal I7 of the PLC 32.

An eighth, normally open switch 208 is associated with and proximate to the feed gate (not shown) of the compactor/baler 30. Whenever the feed gate, which is used for the insertion of material to be compacted, is closed, the eighth switch 208 is closed so that a 24 volt DC voltage is provided along line 108 to input terminal I8 of the PLC 32.

A ninth, normally open switch 209 is associated with an overload breaker (not shown) of the compactor/baler 30. The overload breaker is tripped as an indication of a wiring fault or other overload condition occurring in the compactor/baler 30. Whenever the overload breaker is tripped, the ninth switch 209 is closed so that a 24 volt DC voltage is provided along line 109 to input terminal I9 of the PLC 32.

A tenth, normally open switch 210 is associated with the motor starter auxiliary contact (not shown) of the compactor/baler 30. The motor starter auxiliary contact is actuated during start up of the motor. Whenever the motor starter auxiliary contact is actuated the tenth switch 210 is closed so that a 24 volt DC voltage is provided along line 110 to input terminal IA of the PLC 32.

An eleventh, normally open switch 211 is associated with the ram gate (not shown) of the compactor/baler 30. The ram gate is usually closed during operation of the compactor/baler 30. Whenever the ram gate is closed, the eleventh switch 211 is closed so that a 24 volt DC voltage is provided along line 115 to input terminal IF of the PLC 32.

A twelfth, normally open switch 212 is associated with the key on/off switch 44 of the compactor/baler 30. The key on/off switch 44 controls the application of power from a power source 45 to the compactor/baler 30. Whenever the key on/off switch 44 is turned on by a user, power, in the present embodiment three phase AC power, from the power source 45 is provided to the compactor/baler 30 and to the power supply 38. Also, when the key on/off switch 44 is turned on, the twelfth switch 212 is closed so that a 24 volt DC voltage is provided along line 116 to input terminal IG of the PLC 32. In addition, when the twelfth switch 212 is closed, a 24 volt DC voltage is provided to illuminate a power on indicator light 46 to confirm to the user that the key power switch is turned on The PLC 32 also provides a series of output signals from a plurality of output pins or terminals of the PLC 32. The output terminals of the PLC 32 essentially function as switches which open and close based on the input signals and under the control of the software program stored within the PLC 32 and in the manner shown in the software flow diagrams of FIGS. 2A-N. As shown in FIG. 1, the output signals from the PLC 32 perform a number of functions described as follows:

A first output signal from the O1 output terminal of the PLC 32 functions to connect a 110 AC voltage which is provided from the power source 45 along lines 2 and 13 to a motor contactor 48 of the compactor/baler 30. Connecting the 110 volt AC voltage to the motor contactor 48 causes the motor to operate.

A second output signal from the O2 output terminal of the PLC 32 functions to connect the 110 AC voltage signal from the power source 45 along lines 2 and 14 to the up solenoid 50 of the compactor/baler 30. Connecting the 110 AC voltage to the up solenoid 50 causes the up solenoid 50 to be energized to move the ram upwardly.

A third output signal from the O3 output terminal of the PLC 32 functions to connect the 110 AC voltage signal from the power source 45 along lines 2 and 15 to the down solenoid 52 of the compactor/baler 30. Connecting the 110 AC voltage to the down solenoid 52 causes the down solenoid 52 to be energized to move the ram downwardly.

A fourth output signal from the O6 output terminal of the PLC 32 functions to connect the 28 volt DC voltage from the power supply 38 to illuminate an overload tripped indicator light 54 whenever an overload breaker is tripped.

A fifth output signal from the O7 output terminal of the PLC 32 functions to connect the 28 volt DC voltage from the power supply 38 to illuminate a bale full indicator light 56 whenever a full bale is present.

A sixth output signal from the O8 output terminal of the PLC 32 functions to connect the 28 volt DC voltage from the power supply 38 to illuminate an ok to run indicator light 56.

A seventh output signal from the O9 output terminal of the PLC 32 functions to connect the 28 volt DC voltage from the power supply 38 to illuminate a gate shut indicator light 58 confirming that the gate is shut.

An eighth output signal from the OA output terminal of the PLC 32 functions to connect the 28 volt DC voltage from the power supply 38 to illuminate a call for preventative maintenance (PM) indicator light 60.

The diagnostic system 10 includes a communication port, such as a phone modem 64 and an alarm monitor 66 which are both in communication with the PLC 32. The phone modem 64 is used for contacting a remote location, such as a service facility, and transmitting alert information. The alarm monitor 66 allows actual message functions to be added to the PLC 32 program and to interface the messages with the phone modem 64 for transmission of the messages to a remote location as a text alert, counter value, or the like. Depending on the category of a fault and other considerations, an alert may be generated such that the phone modem 64 sends the alert to a phone or other components or equipment at a remote location, such as a centrally located monitoring station or service facility. Any alert sent by the PLC 32 and alarm monitor 66 by way of the phone modem 64 can include a text component and a numerical value. The PLC 32 can also accept queries from remotely located computers or other equipment by way of the phone modem 64. For diagnostic purposes any and all alerts can be triggered directly or by an input or output of the PLC 32 and any faults may be sent. For example, an alert can be sent by the phone modem every time that the emergency stop button is pressed or every time the bale full indicator light 56 is illuminated. It will be appreciated that some other communications medium, such as the internet, could be used as an alternative way to transmit alerts and other information to a remotely located facility.

The diagnostic system 10 and particularly the software program within the PLC 32 functions to identify errors or faults and generate as needed alerts based upon the performance of the compactor/baler 30 and/or various components within the compactor/baler 30. The identified faults are categorized into three levels as follows:

1. Preventative Maintenance (PM) level faults which provide an indication to the user in the form of an illuminated indicator light and/or a textual alert or other alert on the LCD 34.
2. Level I faults which, in addition to providing an indication to the user or on site service technician in the form of an illuminated indicator light and/or a textual or other alert on the LCD 34, shuts down operation of the compactor/baler. The Level I faults may be cleared by the user or service technician resolving the fault condition to restore the operational condition of the compactor/baler 30.
3. Level II faults which, in addition to providing an indication of a potential component failure which may require attention by a user or service technician in the form of an alert which is sent to a remote location by the phone modem 64 and which may also be indicated by an illuminated indicator light and/or a textual or other alert on the LCD 34 shuts down operation of the compactor/baler 30. The Level II faults may be cleared by the user or preferably by a service technician resolving the fault condition and resetting the error using the LCD push-buttons 36 to restore the operational condition of the compactor/baler 30.

Summary of the Operation of the PLC Logic for Determination of an Alert:

Preventive Maintenance (PM) Level Faults

Figure 2A:
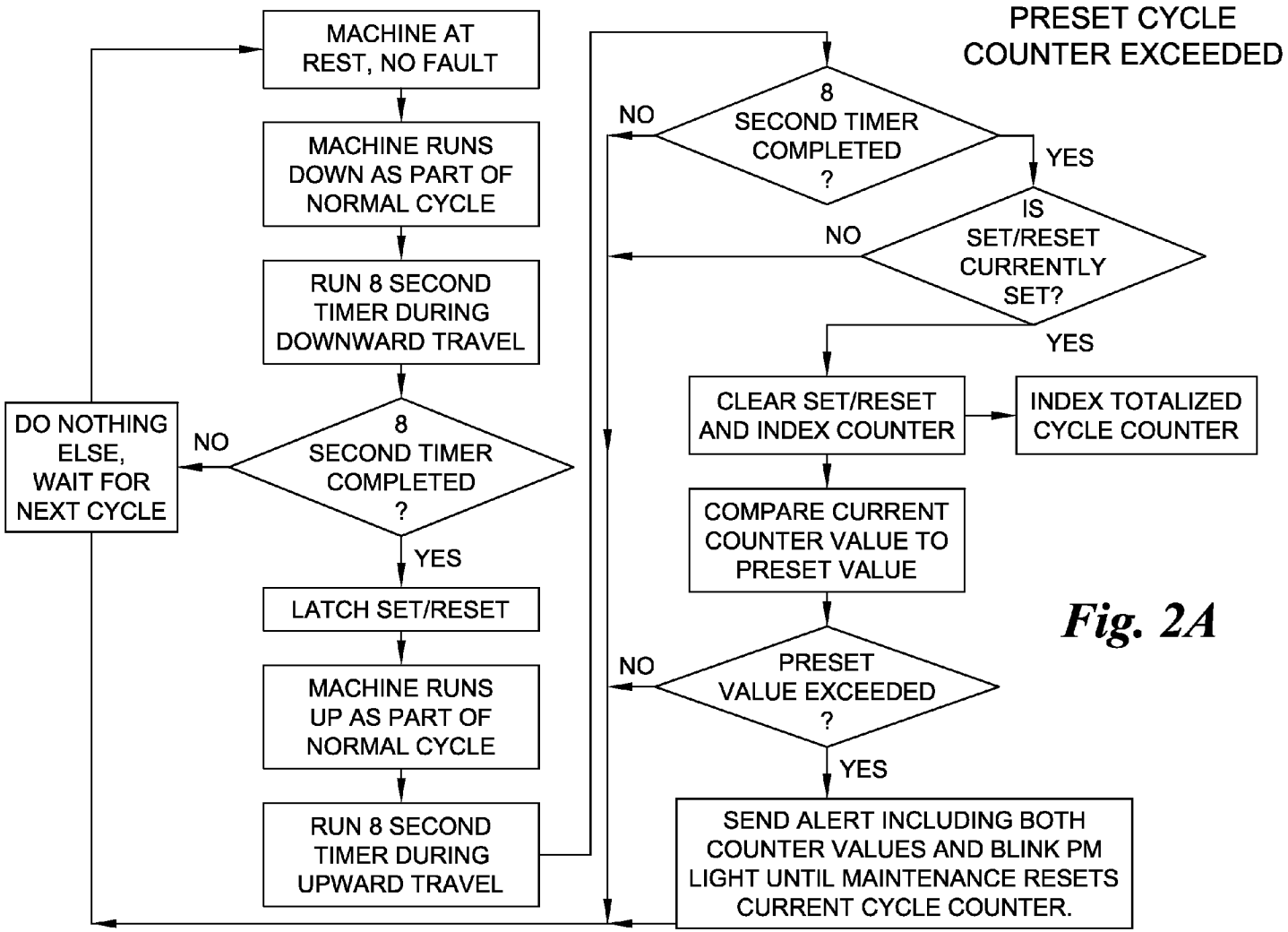
FIGS. 2A-N are schematic flow diagrams illustrating the operation of the software of the diagnostic system of FIG. 1.
Figure 3:
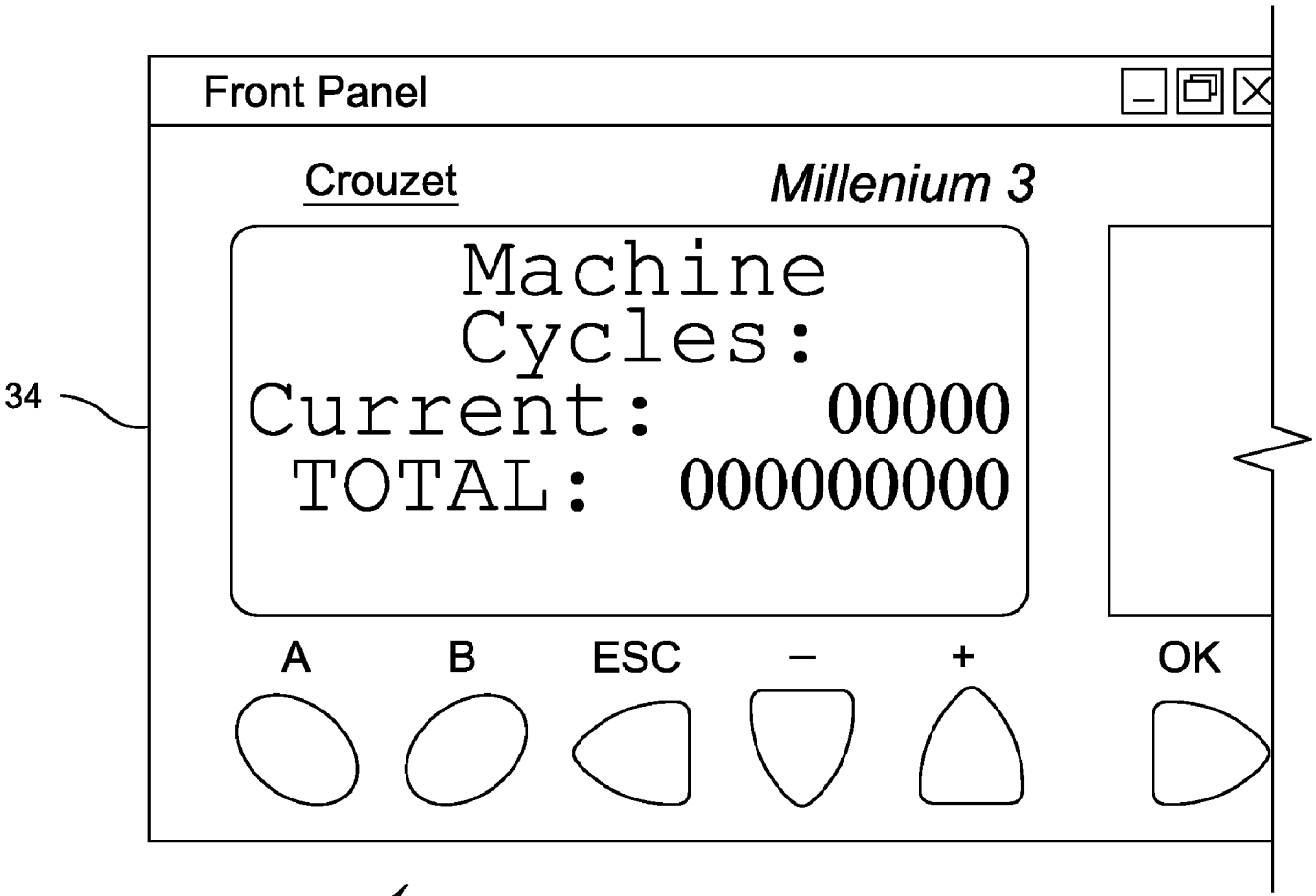
FIG. 3 is a screenshot of the front panel of the diagnostic system of FIG. 1.

Preset cycle counter exceeded—The software program, as shown by the flow diagram of FIG. 2A, counts the total number of cycles of the compactor/baler 30 and continually compares the count to a stored pre-programmed number. If the number of cycles completed by the compactor/baler 30 (count) exceeds the pre-programmed number, the PLC 32 illuminates the call for PM indication light 62 and an alert can be sent to a remote location using the phone modem 64. The alert can include the total number of machine cycles achieved to date. There are two concurrent cycle counters, a first cycle counter that cannot be reset (like the odometer on a car) that counts the total number of compactor/baler cycles since the compactor/baler 30 was installed and a second cycle counter that can be reset (like the trip odometer on a car) that counts the number of compactor/baler cycles since the last time the counter was reset. The total number of cycles (first counter) and the current number of cycles (second counter) are displayed on one of the screens of the LCD 34.

Figure 2B:
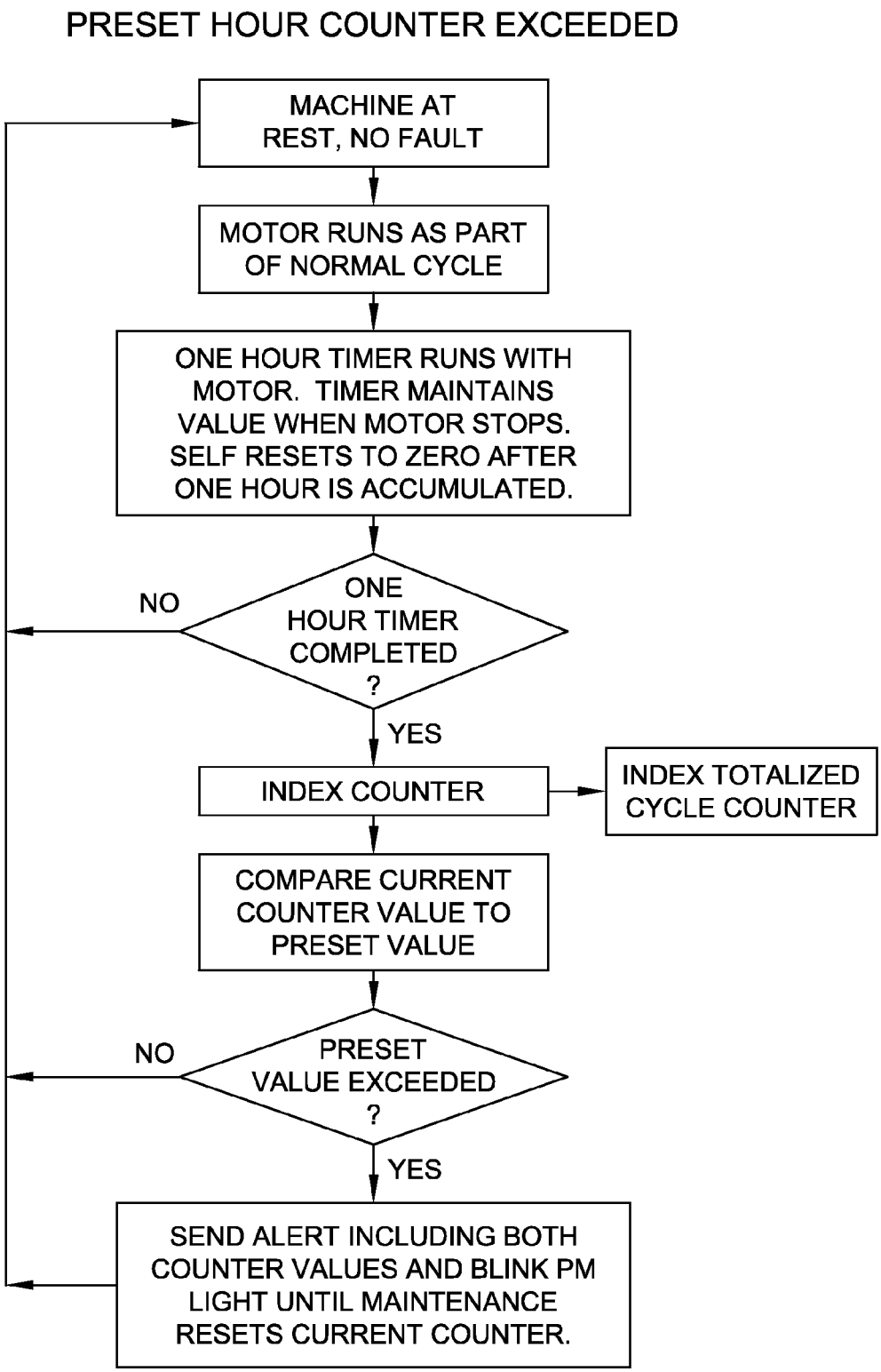

Preset hour counter exceeded—The software program as shown by the flow diagram of FIG. 2B counts the total number of compactor/baler 30 operation hours (the number of hours the motor contact is engaged) and continually compares the count to a stored pre-programmed number. If the number of operating hours completed exceeds the preset number, the call for PM indication light 62 illuminates and an alert can be sent to a remote location using the phone modem 62. The alert which is sent can include the total number of operating hours achieved to date. There are two concurrent operating hour timers, a first counter that cannot be reset to represent the total hours of operation across the entire life of the compactor/baler 30 and a second counter that can be reset to represent the number of operating hours of the compactor/baler 30 since the last time the second counter was reset, such as at the last time the compactor/baler 30 was serviced. The total number of hours of usage (first counter) and the current number of hours of usage (second counter) are displayed on one of the screens of the LCD 34.

Figure 2C:
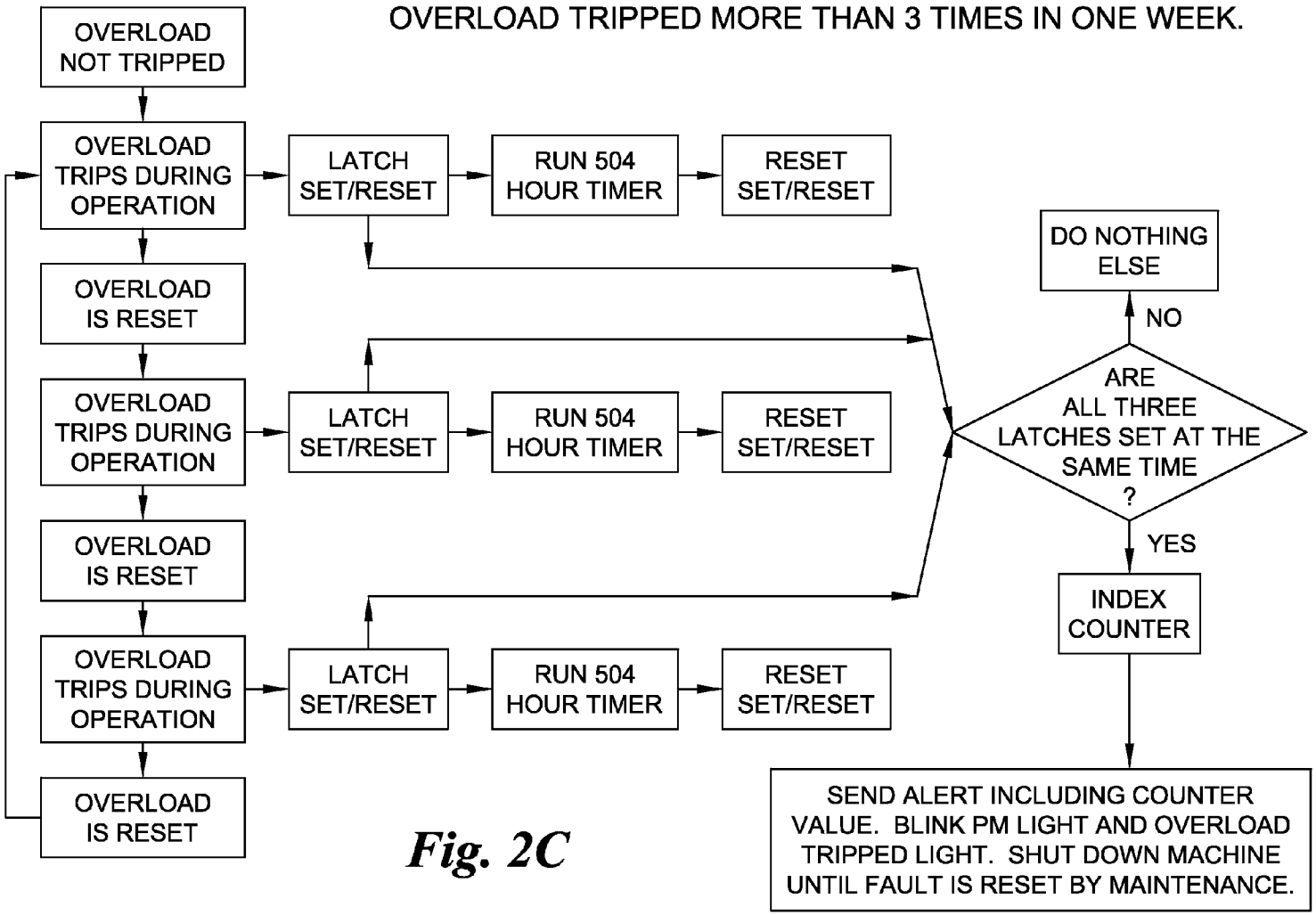

Overload tripped more than 3 times in seven days—The overload tripped indicator light 54 is illuminated if the overload breaker has tripped. An overload breaker tripping can be indicative of compactor/baler 30 or building wiring faults but is not necessary a re-occurring issue requiring immediate attention. Once the overload breaker is reset, the compactor/baler 30 can be run normally. The software within the PLC 32, as shown by the flow diagram of FIG. 2C, keeps a running count of how many times the overload breaker has tripped during the previous seven days of compactor/baler operation. If the overload breaker has tripped three or more times during the previous seven days of operation than an alert is triggered and is sent to a remote location by the phone modem 62. The number of occurrences of the overload breaker being tripped within the past seven days can be sent by the phone modem 62 with the alert. An overload breaker trip is also displayed on the LCD 34.

Level I Faults

Figures 1, 2D:
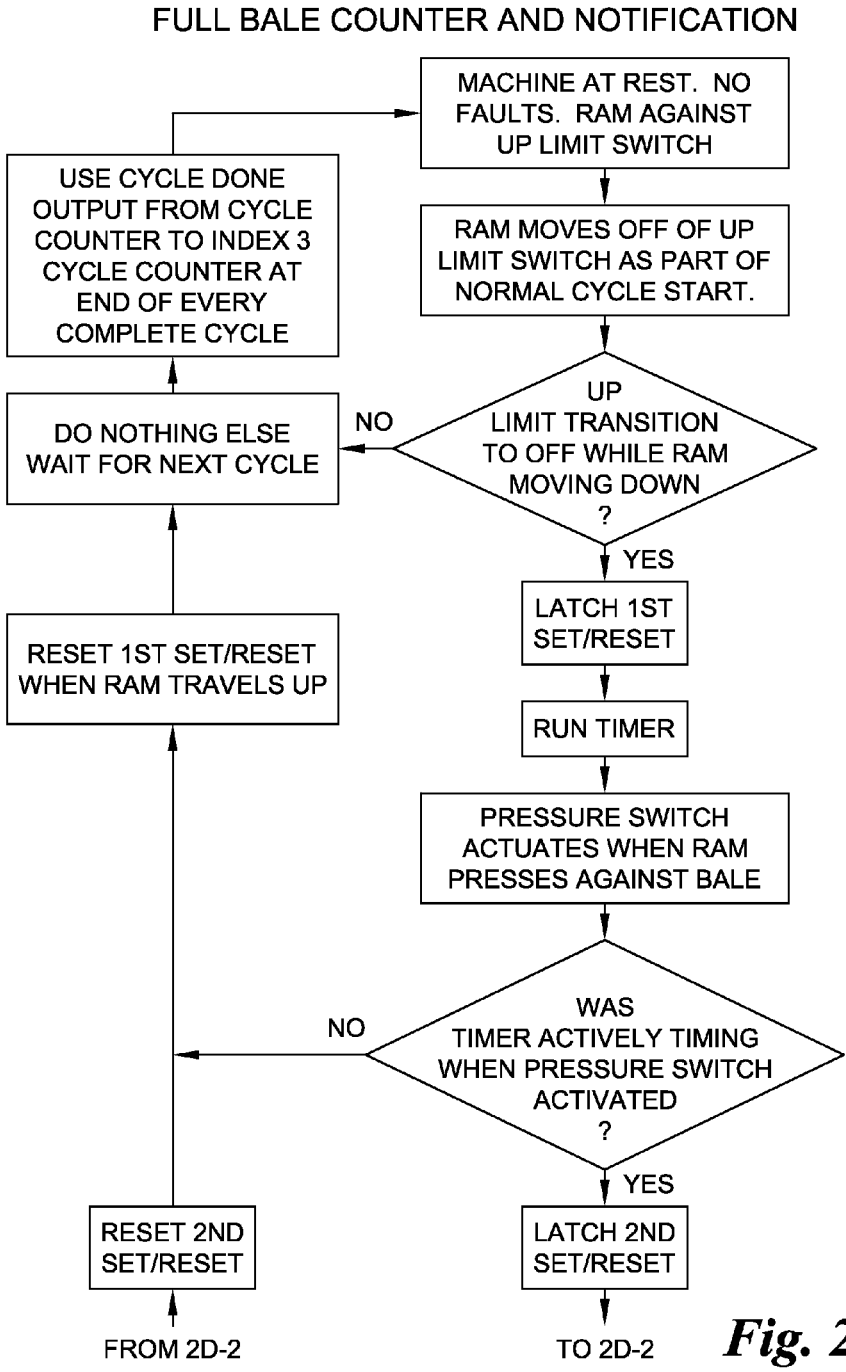
Figures 2, 2D:
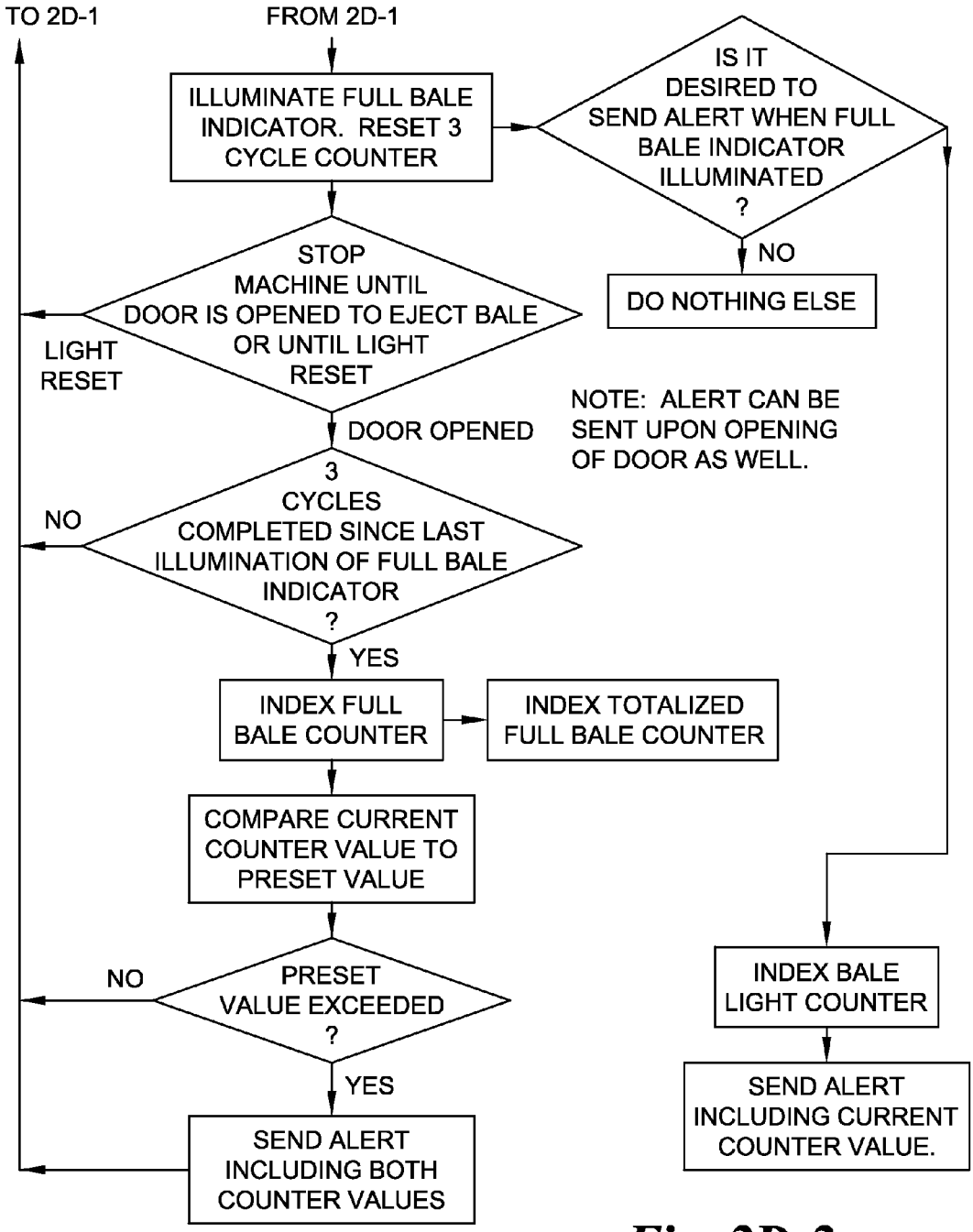

Full Bale—If the hydraulic ram is started from the full up position as determined by the up stop limit switch 207 then a timer is started when the ram starts moving down. Since the compactor/baler 30 utilizes a fixed displacement pump with a fixed RPM motor, the ram moves at a constant rate of speed. If the pressure switch 205 is triggered before the timer setting is exceeded then it is known that the ram is pushing against a full (completed) bale of compacted material. The full bale indicator light 56 is then illuminated. An alert can be triggered from this event but it is not known if the bale has actually been ejected by the compactor/baler 30. If the PLC 32 detects the bale door opening (switch 206) while the full bale indicator light 56 is illuminated it is assumed a full bale has been both made and ejected from the compactor/baler 30. However, it is still possible to close the bale door at this point without ejecting the bale and then restart the compactor/baler 30 and repeat the process to artificially raise the full bale count. Therefore the software program as shown by the flow diagram of FIG. 2D includes another counter to check that a minimum of three compactor/baler 30 cycles have been completed since the last full bale indication to avoid false bale counts. If at least three cycles have been completed since the last full bale was detected and the bale door has been opened then the bale count is increased by one. At this point an alert can be sent to a remote location by the phone modem 64 and the bale count can be transmitted with the alert. There are two bale counters, one resettable and one non-resettable. Multiple alerts can be sent by the phone modem 64 if both values are desired. A predetermined number of bales is also indicative that the bales should be picked up by a hauler. The total number of bale (first counter) and the current number of bales (second counter) are displayed on one of the screens of the LCD 34.

Figure 2E:
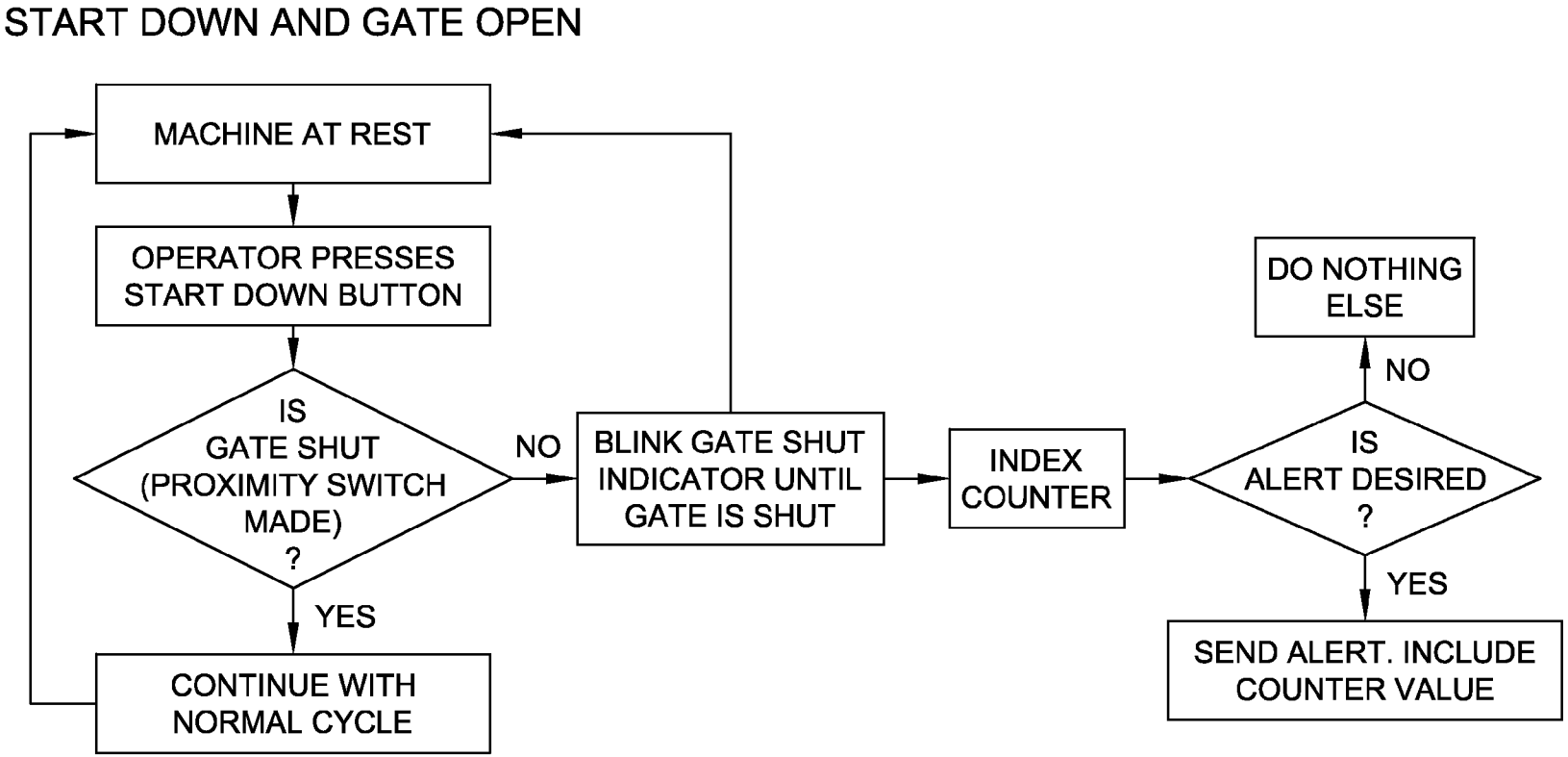

Start down and gate open—This event would not typically be worthy of an alert being sent by the phone modem 64 but is available if the need arises. For safety reasons, the compactor/baler 30 will not run the ram down with the ram gate open (switch 204). If the start down button (switch 202) is pressed by a user while the ram gate is open (switch 204) then the software program as shown by the flow diagram of FIG. 2E, will cause the gate shut indicator light 60 to flash to provide a warning to the user that the ram gate is not fully closed. Simply closing the ram gate will stop the shut gate indicator light 60 from flashing and will allow the compactor/baler 30 to operate normally. The flashing gate shut indicator light 60 eliminates unnecessary service calls from being placed. A counter in the software stores the number of times of the occurrence of the flashing gate shut indicator light 60 and if the number of occurrences exceeds a threshold an alert may be sent to a remote location by the phone modem 62 along with the count of the previous occurrences. A ram gate open status is also displayed on the LCD 34.

Figure 2F:
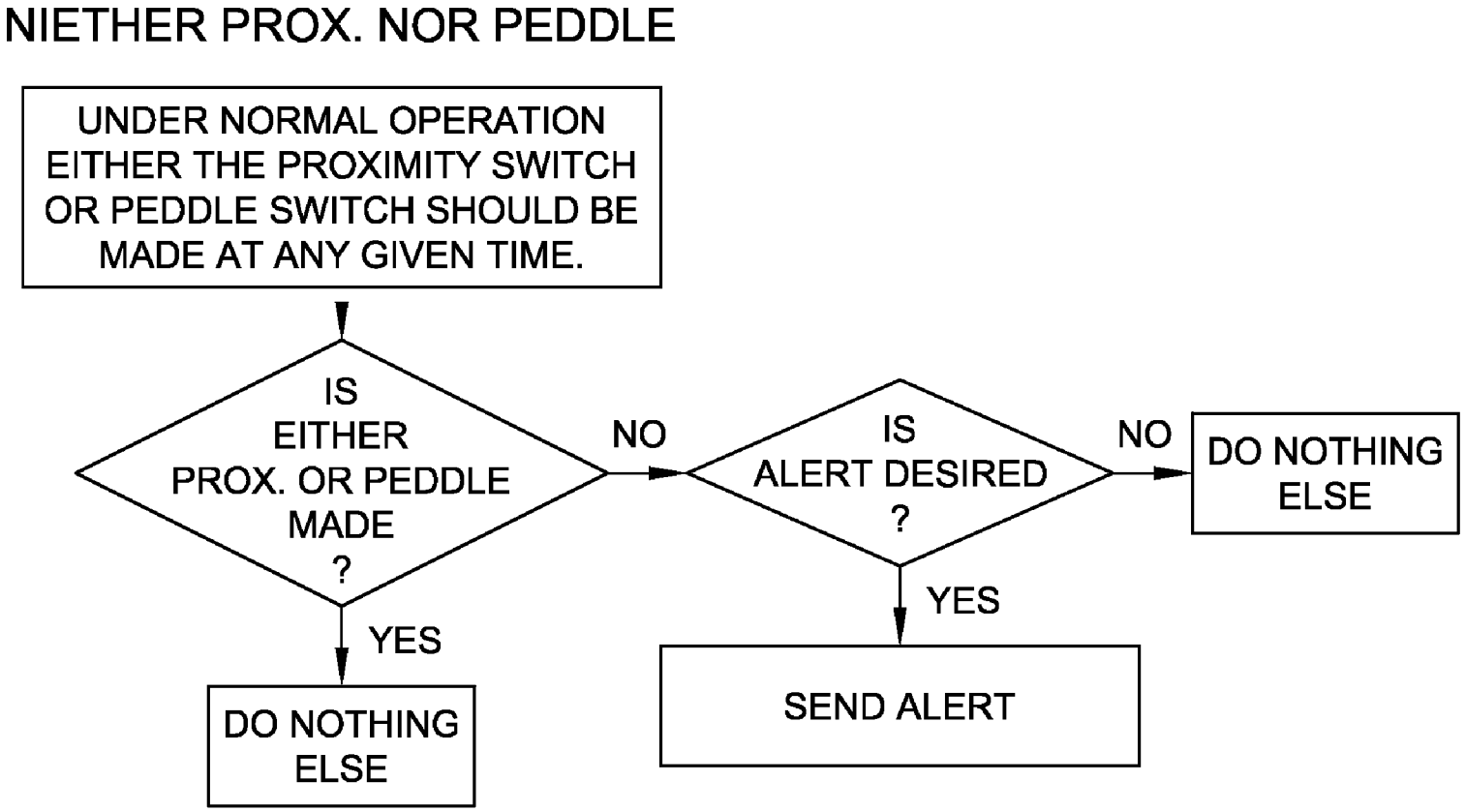

Neither Proximity switch not peddle switch—Under normal conditions the compactor/baler 30 will not operate unless either the gate proximity switch (208) or a gate peddle switch is actuated. This does not necessarily indicate a fault in the compactor/baler 30 as it can be an operator error. This occurrence is treated by the software program as shown by the flow diagram of FIG. 2F, the same way as the start down and gate open, as described above.

Figure 2G:
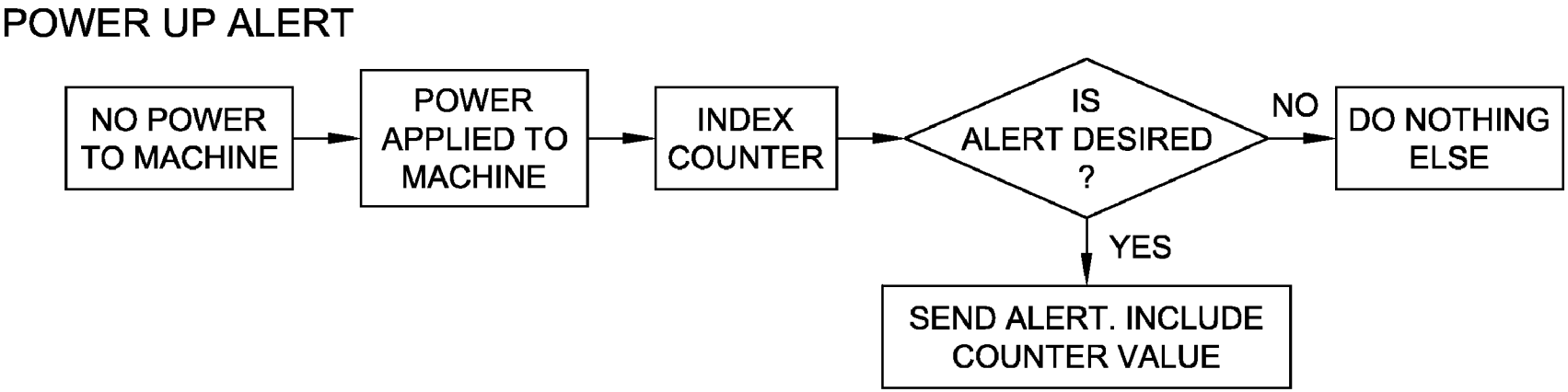

Key Switch turned off, Emergency Stop Button Pressed, Overload Breaker Tripped—None of these events, by themselves and occasionally occurring necessarily indicate a fault in the compactor/baler 30 but are readily available to trigger an alert if necessary or desired for diagnostic purposes, as shown by the flow diagram of FIG. 2G.

Level II Faults

Figure 2H:
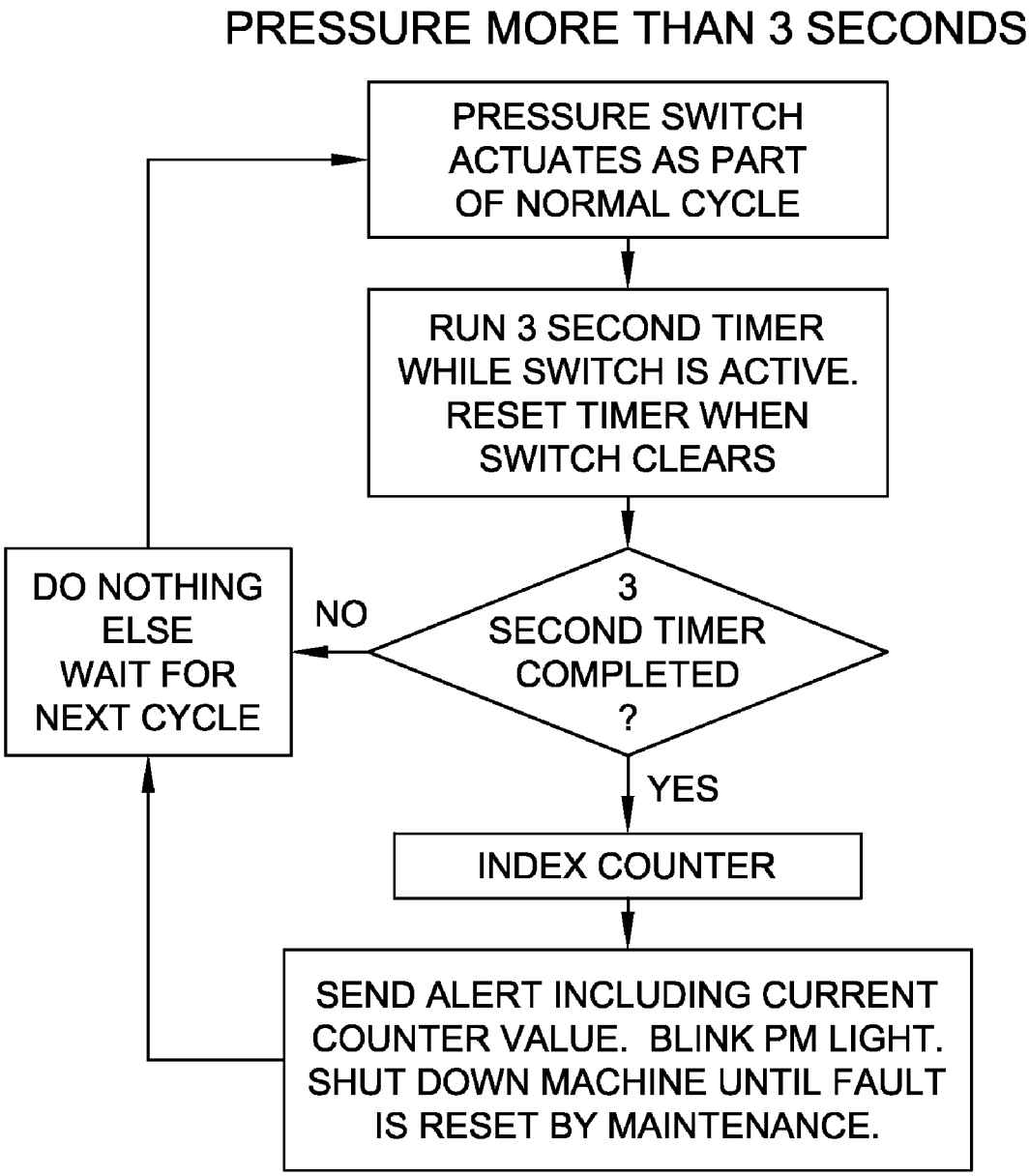

Pressure switch actuated more than three seconds—As shown by the flow diagram of FIG. 2H, the software implements a timer which is started every time the pressure switch within the compactor/baler 30 actuates (pressure switch actuates when the hydraulic pressure for moving the ram exceeds a discrete preset trigger pressure typically because high resistance is encountered by the ram). The timer, which in the present embodiment is set for three seconds, is reset when the pressure switch is no longer activated. Under normal conditions the pressure would never be held in excess of the pressure switch setting for more than approximately 1 second. If the three second timer times out, an alert can be sent to a remote location using the phone modem 64. The alert can include the total number of previous occurrences of the same alert based upon the output of a timer that counts each such alert.

Figure 2I:
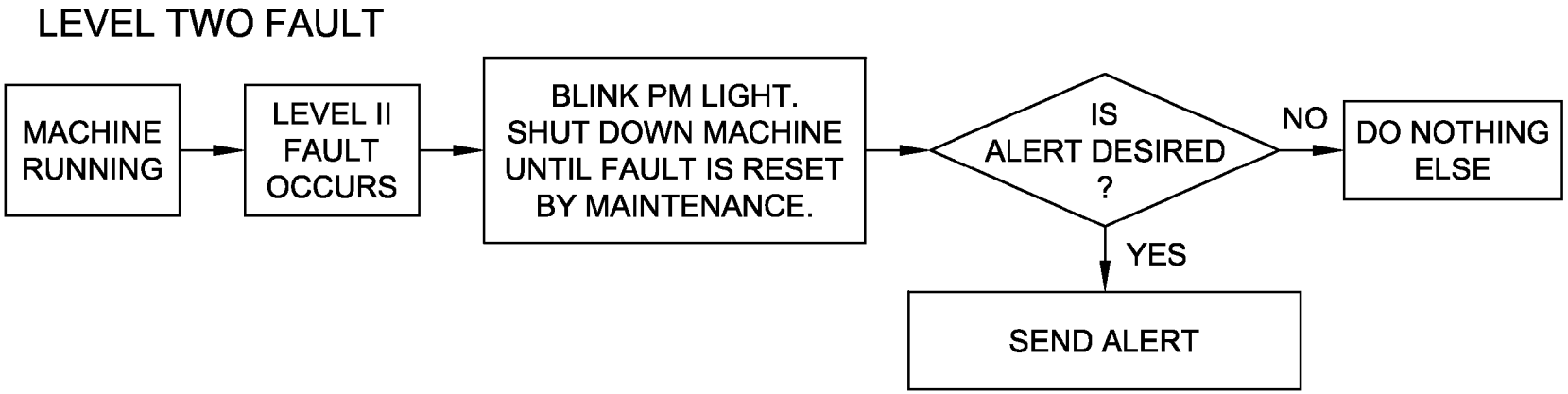

Any Occurrence of a Level II fault—All faults that indicate a potential failure of the compactor/baler 30 worthy of a service technician being dispatched for service to the compactor/baler 30 can also trigger a secondary alert to be sent to a remote location by the phone modem 64 as shown by the flow diagram of FIG. 2I. Different alerts can be sent to different remote locations and lower level alerts may be sent to one phone number with Lever II alerts also being sent to a specific level II fault phone number. Cycle and hours counts exceeded do not indicate a Level II fault but can also be included in the Level II notification to trigger a preventative maintenance call to be scheduled.

Figure 2J:
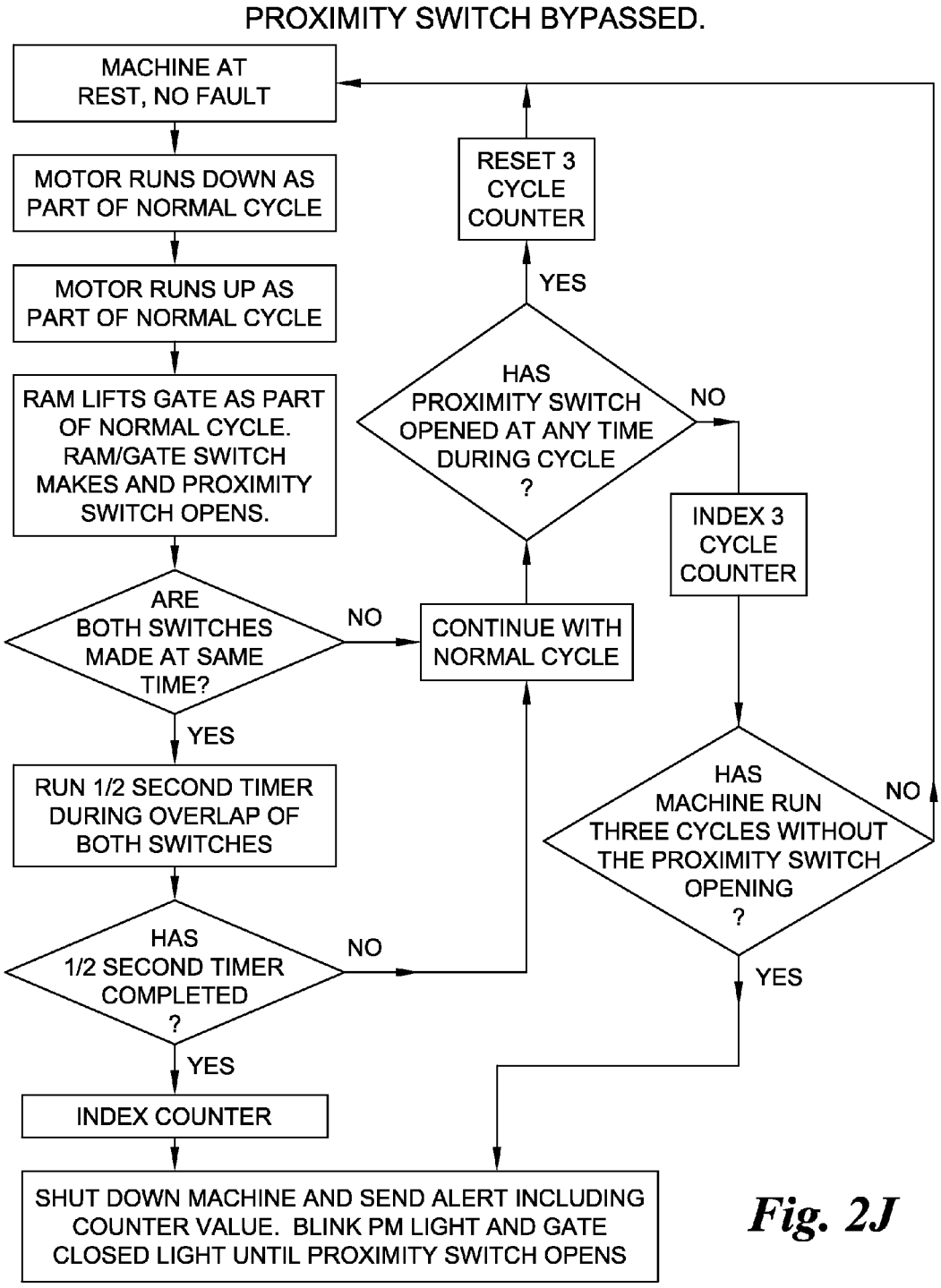

Proximity Switch Bypassed—The proximity switch is an important safety interlock feature that prevents the compactor/baler 30 from operating with the feed gate open (switch 208). If someone were to bypass the proximity switch (208) it would lead to an unsafe operating condition. The software program as shown by the flow diagram of FIG. 2J checks for the potential bypass of the proximity switch in two separate ways. If the compactor/baler 30 operates through three consecutive cycles without the feed gate opening it is assumed that the proximity switch 208 has been bypassed since under normal circumstances the feed gate would need to be opened in order to feed more material into the chamber. Also, if the ram gate switch 204 and the gate proximity switch 208 are both activated at the same time for a period exceeding a couple of seconds, it is assumed that the gate proximity switch 208 has been bypassed since under normal operating conditions the ram will open the gate when the ram gate switch is closed. This will cause the gate shut indicator light 60 and the PM required indicator light 62 to both flash. At this time an alert will also be sent by the phone modem 62 including a count of the previous occurrences.

Figure 2K:
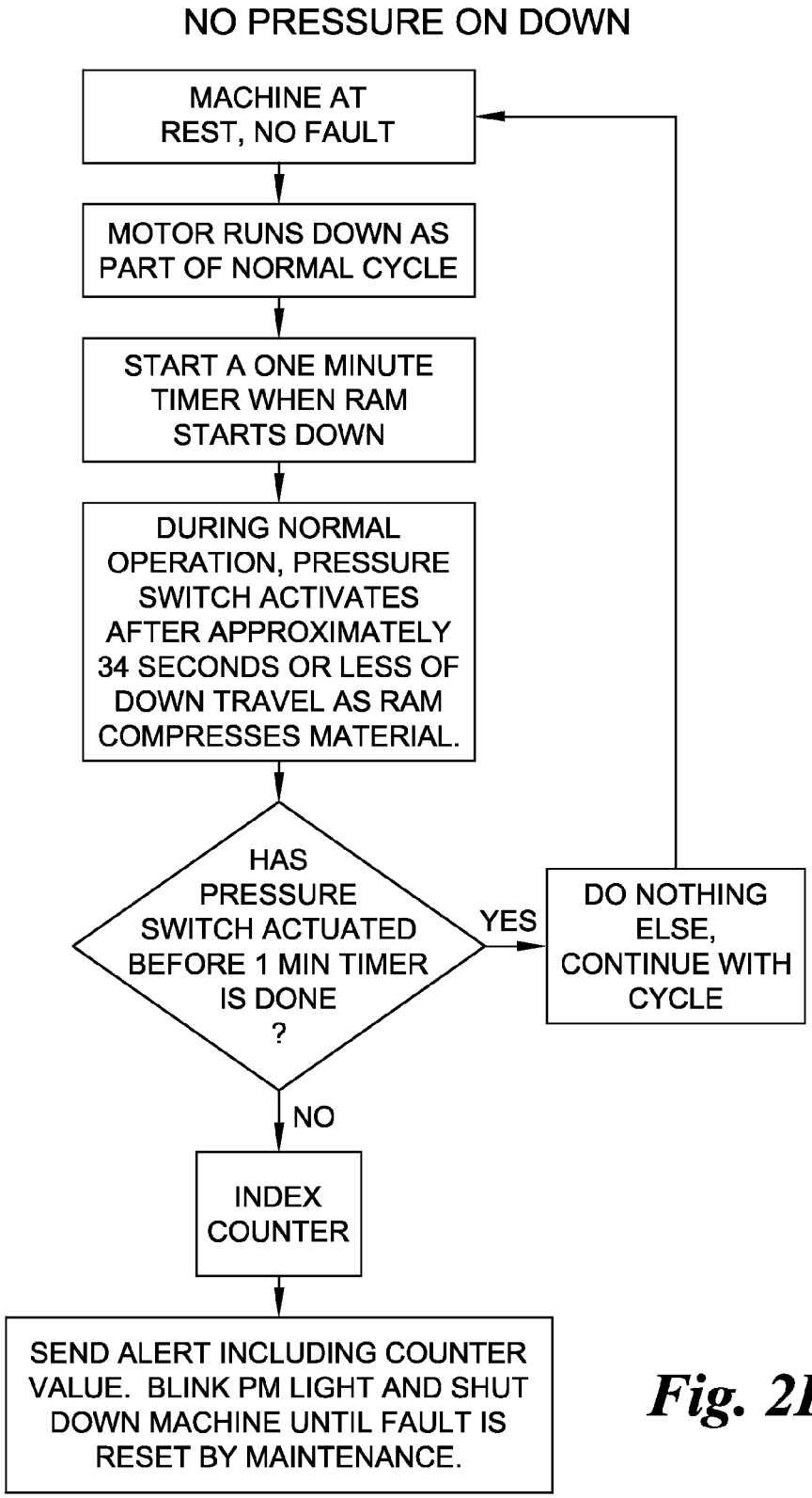

No pressure on down stroke—Under normal circumstances the ram moves downwardly until pressure is achieved against a partial bale in the baler chamber or until pressure is achieved (indicated by closing of switch 205) against the end of the cylinder stroke. The ram shifts direction and starts traveling upwardly as soon as pressure is achieved. Since the ram normally travels from the full up to the full down position in approximately ½ minute, an alert is triggered and sent to a remote location by the phone modem if the ram has been traveling downwardly for more than one minute without achieving pressure. A counter stores the number of previous occurrences of the time being exceeded and the number of occurrences can be sent by the phone modem 62 with the alert as shown by the flow diagram of FIG. 2K.

Figure 2L:
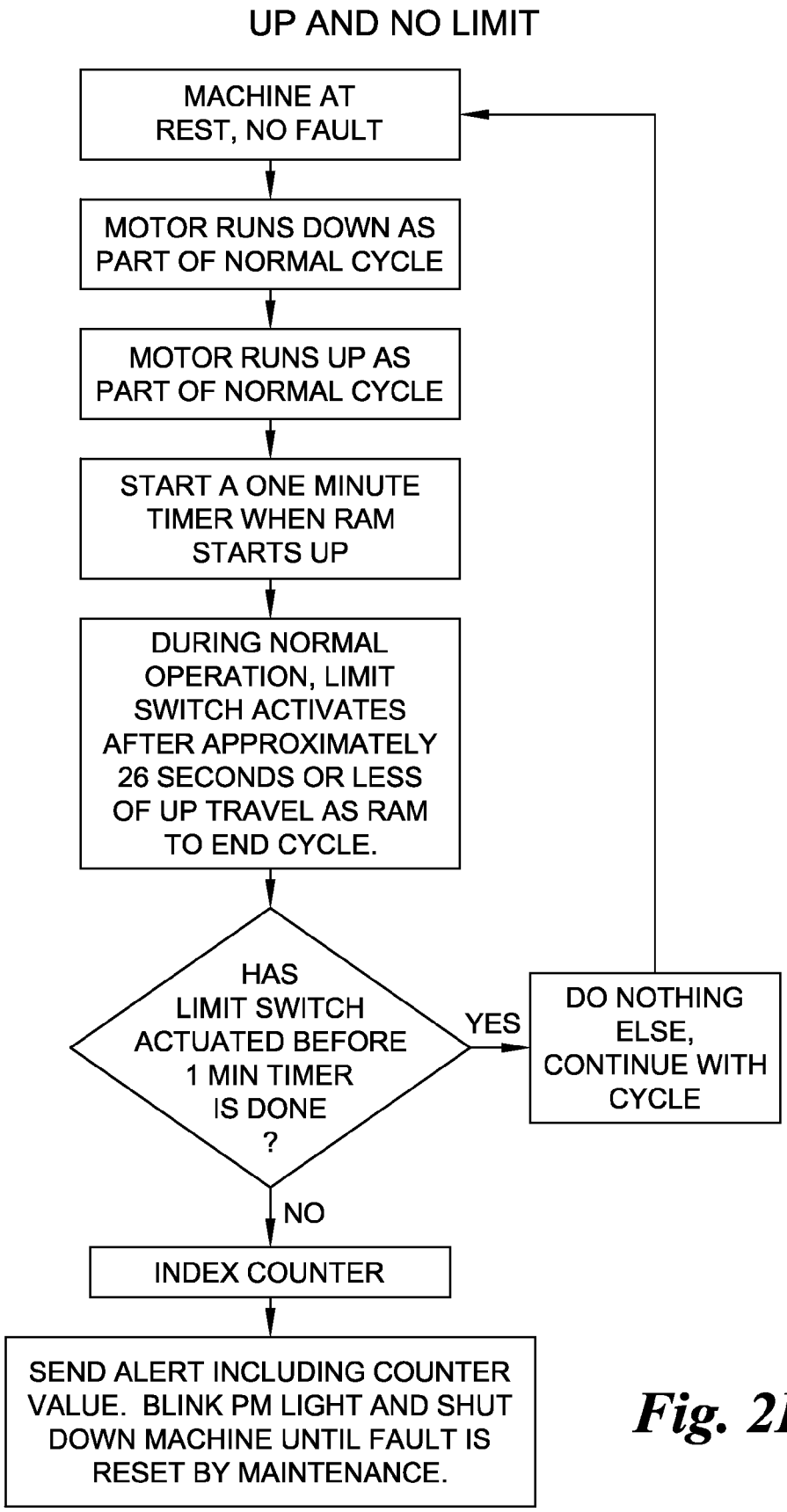

Upstroke and no limit switch actuation—During normal operation of the compactor/baler 30 the ram travels upwardly until the up limit switch (207) is actuated. If the ram has been traveling upwardly for more than one minute without actuating the up limit switch, an alert is triggered and sent to a remote location by the phone modem 62. A counter stores the number of previous occurrences of the time being exceeded and the number of occurrences can be sent by the phone modem 62 with the alert as shown by the flow diagram of FIG. 2L.

Figure 2M:
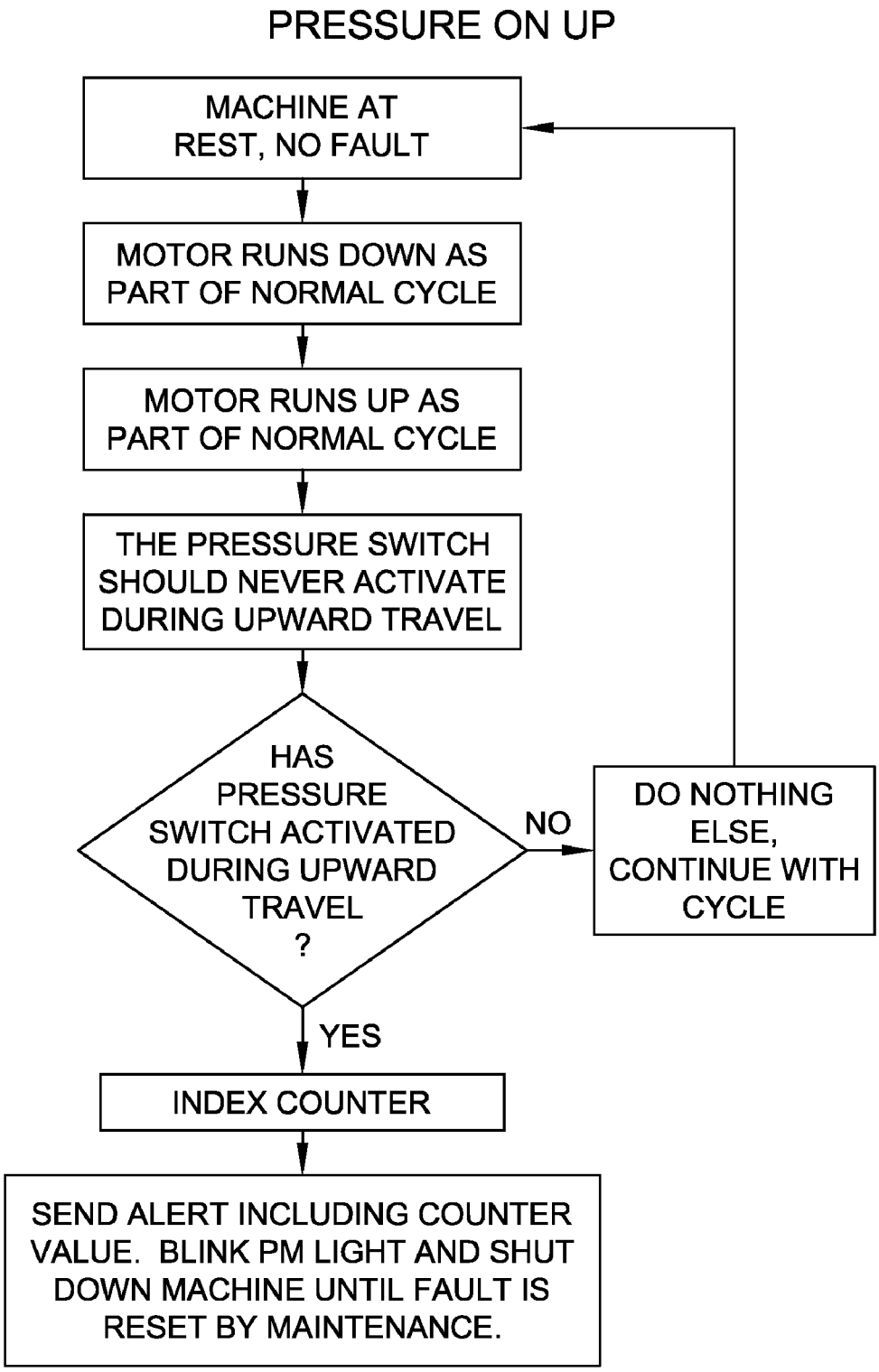
Figure 2N:
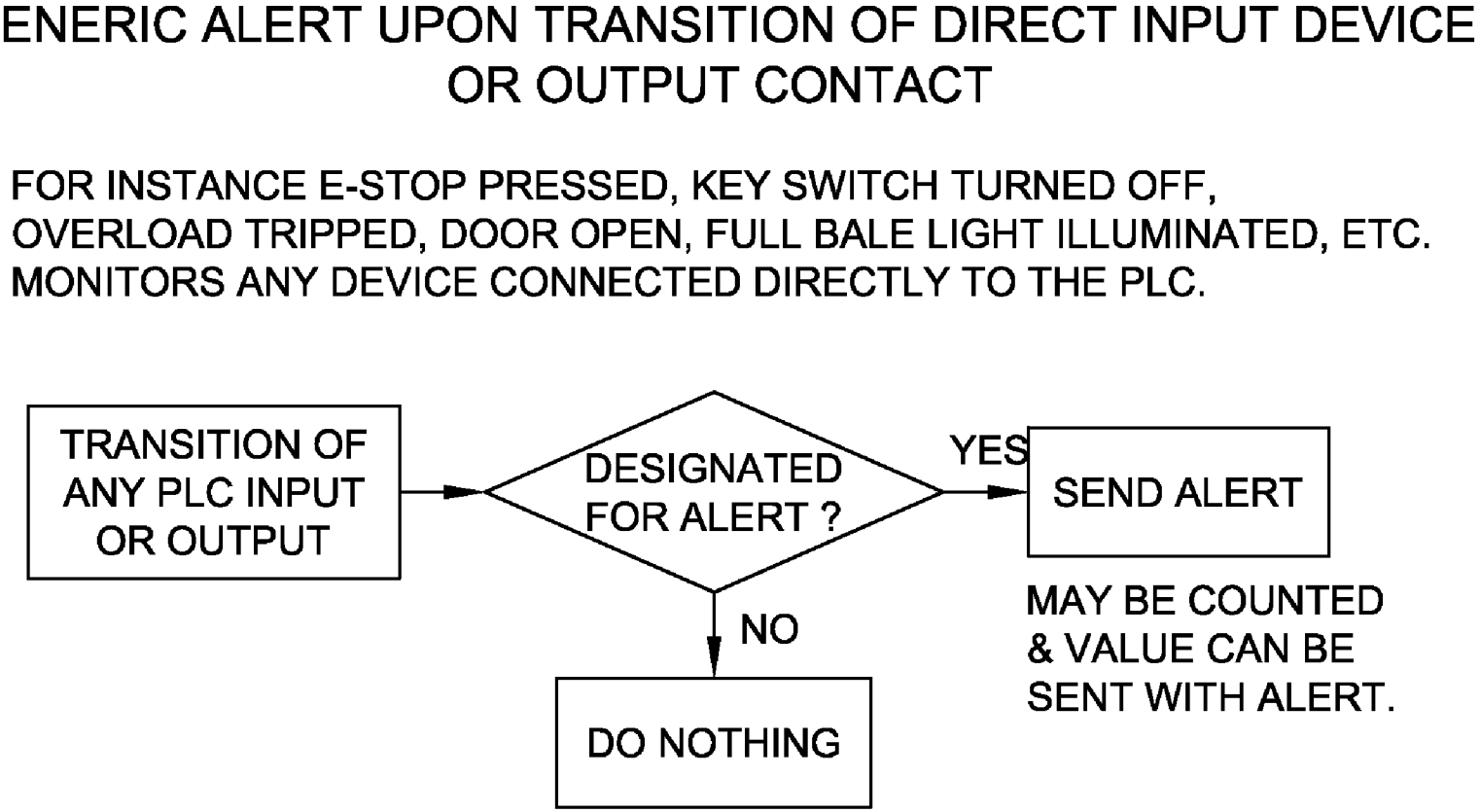

Pressure switch actuated on up stroke—During normal operation of the compactor/baler 30 pressure is never achieved on the upward ram stroke. If the ram is traveling upwardly and the pressure switch 205 is activated then an alert is triggered and sent to a remote location by the phone modem 62. A counter stores the number of previous occurrences of the activation of the pressure switch and the number of occurrences can be sent by the phone modem 62 with the alert as shown by the flow diagram of FIG. 2M.

From the foregoing, it can be seen that the present invention comprises a diagnostic system for a commercial/industrial compactor/baler. It will be appreciated by those skilled in the art that changes could be made to the embodiment described above without departing from the broad inventive concepts thereof. For example, a method other than using a phone modem, such as by internet or by a direct connection, could be used to send alerts to one or more remote locations. Also, a lesser or greater number of different types of errors/faults could be monitored. A different type of display, such as a larger or smaller LCD or other type of display device could be used. It is understood, therefore, that this invention is not limited to the particular embodiment disclosed, but it is intended to cover all modifications within the spirit and scope of the present invention.

We claim:

1. A diagnostic system for a compactor/baler apparatus comprising:

(a) a controller having a plurality of inputs and a plurality of outputs;

(b) a plurality of switches each coupled to a respective one of the plurality of inputs of the controller, (i) a first of the plurality of switches being in a first position when a ram of the compactor/baler apparatus is below a predetermined location and being in a second position when the ram reaches the predetermined location, (ii) a second of the plurality of switches being in a first position when a pressure driving the ram is below a predetermined pressure limit and being in a second position when the ram exceeds the predetermined pressure limit;

(c) a communication port operatively coupled to a first output of the plurality of outputs of the controller; and (d) a display operatively coupled to a second output of the plurality of outputs of the controller, the controller being configured to:

(i) upon actuation of the first switch to the first position, activate a ram timer to count to a predetermined timer setting, and (ii) if the second switch is actuated to the second position before the ram timer reaches the predetermined timer setting, output an alert indicating a full bale condition to at least one of the communication port and the display.

2. The diagnostic system of claim 1, wherein the controller is further configured to increment a cycle counter each time the ram counter reaches the predetermined timer setting before the second switch is actuated to the second position.

3. The diagnostic system of claim 2, wherein a third of the plurality of switches is in a first position when a bale door of the compactor/baler apparatus is closed and in a second position when the bale door is open.

4. The diagnostic system of claim 3, wherein the controller is further configured to increment a full bale counter when the controller indicates the occurrence of a full bale condition, the cycle counter has been incremented by a predetermined amount since the last indication of a full bale condition, and the third switch has been actuated to the second position.

5. The diagnostic system of claim 1, wherein the controller includes a third output configured to connect a power supply of the compactor/baler apparatus to an up solenoid configured to move the ram upwardly when the up solenoid is connected to the power supply, and a fourth output configured to connect the power supply of the compactor/baler apparatus to a down solenoid configured to move the ram downwardly when the down solenoid is connected to the power supply.

6. The diagnostic system of claim 5, wherein the controller is further configured to output an alert to at least one of the communication port and the display when the first switch is not actuated to the second position during a predetermined time that the up solenoid is connected to the power supply.

7. The diagnostic system of claim 5, wherein the controller is further configured to output an alert to at least one of the communication port and the display when the second switch is actuated to the second position while the up solenoid is connected to the power supply.

8. The diagnostic system of claim 5, wherein the controller is further configured to output an alert to at least one of the communication port and the display when the second switch is not actuated to the second position during a predetermined time that the down solenoid is connected to the power supply.

9. The diagnostic system of claim 1, wherein the controller is further configured to output an alert to at least one of the communication port and the display when the second switch is actuated to the second position for longer than a predetermined time.

10. The diagnostic system of claim 1, wherein the communication port is a telephone modem.

11. The diagnostic system of claim 1, wherein the display is at least one of a liquid crystal display screen and an indicator light.

12. A diagnostic system for a compactor/baler apparatus comprising:

(a) a controller having a plurality of inputs and a plurality of outputs;

(b) a plurality of switches each coupled to a respective one of the plurality of inputs of the controller, (i) a first of the plurality of switches being in a first position while a start down button is actuated to initiate downward motion of a ram of the compactor/baler apparatus in a downward direction, and otherwise being in a second position, (ii) a second of the plurality of switches being in a first position when a ram gate of the compactor/baler apparatus is closed and being in a second position when the ram gate is open, and (iii) a third of the plurality of switches being in a first position when a feed gate of the compactor/baler apparatus is open and in a second position when the feed gate is closed, (c) a communication port operatively coupled to a first output of the plurality of outputs of the controller;

(d) a display operatively coupled to a second output of the plurality of outputs of the controller;

(e) a down solenoid selectively connectable to a power supply of the compactor/baler apparatus by a third output of the plurality of outputs of the controller, the down solenoid being configured to move the ram in a downward direction when connected to the power supply; and (f) an up solenoid selectively connectable to the power supply by a fourth output of the plurality of outputs of the controller, the up solenoid being configured to move the ram in an upward direction when connected to the power supply, the controller being configured to:

(i) increment a cycle counter following completion of a sequence wherein the down solenoid is connected to the power supply for a first period of time and subsequently the up solenoid is connected to the power supply for a second period of time, and (ii) output an alert to at least one of the communication port and the display based upon detection, by the controller, of a predetermined configuration of the plurality of switches.

13. The diagnostic system of claim 12, wherein the plurality of switches further includes:

(iv) a fourth of the plurality of switches being in a first position while an emergency stop button is actuated to stop operation of the compactor/baler apparatus, and otherwise being in a second position, (v) a fifth of the plurality of switches being in a first position when an overload circuit breaker of the compactor/baler apparatus is tripped, and otherwise being in a second position, and (vi) a sixth of the plurality of switches being in a first position when a key on/off switch of the compactor/baler apparatus is turned off and being in a second position when the key on/off switch is turned on, and wherein the controller is configured to output an alert when at least one of (i) the fourth switch is actuated from the second position to the first position, (ii) the fifth switch is actuated from the second position to the first position, or (iii) the sixth switch is in the first position.

14. The diagnostic system of claim 12, wherein the controller is configured to output the alert when the first switch is in the first position and the second switch is in the second position.

15. The diagnostic system of claim 12, wherein the controller is configured to output the alert when the cycle counter is incremented by a predetermined amount and the third switch has not been actuated from the second position to the first position.

16. The diagnostic system of claim 12, wherein the communication port is a telephone modem.

17. The diagnostic system of claim 12, wherein the display is at least one of a liquid crystal display screen and an indicator light.

* * * * *